United States Patent [19]

Spalding

[11] Patent Number: 4,533,802

[45] Date of Patent: Aug. 6, 1985

[54] LIQUID FLOW SWITCH AND METHOD OF USING SAME

[75] Inventor: Peter S. Spalding, Martville, N.Y.

[73] Assignee: Alcan Aluminun Corporation, Cleveland, Ohio

[21] Appl. No.: 619,851

[22] Filed: Jun. 12, 1984

[51] Int. Cl.[3] ..... H01H 35/38

[52] U.S. Cl. ..... 200/81.9 R; 200/81.9 M; 200/84 C

[58] Field of Search ..... 200/81.9 R, 81.9 M, 200/82 E, 84 R, 84 C, 81 R

[56] References Cited

U.S. PATENT DOCUMENTS

| | | | |
|---|---|---|---|
| 2,791,657 | 5/1957 | Bloxsom et al. | 200/81.9 M |
| 3,327,079 | 6/1967 | Widl | 200/81.9 M |
| 3,431,375 | 3/1969 | Hotchkiss | 200/82 E |
| 3,947,813 | 3/1976 | Uemura et al. | 200/84 C X |
| 3,958,092 | 5/1976 | Hoover | 200/81.9 M |
| 4,365,125 | 12/1982 | Keller | 200/81.9 M |

*Primary Examiner*—J. R. Scott

*Attorney, Agent, or Firm*—Cooper, Dunham, Clark, Griffin & Moran

[57] ABSTRACT

A switch responsive to changes in flow rate of a flow of liquid including a chamber with a liquid flow inlet and outlet at an upper level and a restricted orifice at a lower level for continuously bleeding liquid from the chamber, such that the liquid level in the chamber rises when the inlet flow rate exceeds the bleed rate but falls when the bleed rate exceeds the inlet flow rate. A float-type level sensing switch is disposed in the chamber for producing a signal, representative of a change in inlet flow rate, when the liquid level in the chamber passes through a predetermined level intermediate the outlet and the orifice. An adjusting element such as a screw projecting transversely into the orifice may be provided to enable variation of orifice cross-sectional area thereby to set the bleed rate at a desired value.

8 Claims, 15 Drawing Figures

LIQUID FLOW SWITCH AND METHOD OF USING SAME

BACKGROUND OF THE INVENTION

This invention relates to switches for producing a signal in response to increase and/or decrease in flow rate of a flow of liquid beyond a predetermined value, and to methods of using such switches. In a particular sense, it is directed to switches capable of detecting and signalling minor changes of flow in a gravity drain even at very low mass flow rates.

For various purposes, it is desirable to sense small changes in liquid flow rates under conditions of low mass flow. An example is in the lubricating systems employed in sheet metal rolling lines. In such a system, a so-called relubricating machine supplies oil to an open trough and several spray nozzles pick up oil from the trough for application to a surface to be lubricated. Excess oil flows out of the trough to a gravity drain and is recirculated. The location of the trough, in the apparatus with which it is associated, precludes convenient direct measurement or observation of the oil level in the trough. However, as long as a sufficient flow of oil leaves the trough through the gravity drain, it is known that adequate oil is present in the trough. Accordingly, it would be desirable to provide a switch, responsive to changes in oil flow rate in the gravity drain, for providing a signal representative of decrease of flow rate below a predetermined value, i.e. to detect insufficient lubricant runoff which indicates insufficient lubricant in the pumping section of the apparatus.

The mass flow rate of oil in the gravity drain, and the magnitude of the changes to be detected, are too small to be sensed by conventional switches such as vane-type flow switches. In particular, known commercially available flow switches do not operate without a flow having significant kinetic energy, i.e. kinetic energy in excess of that characteristic of the drain flows desired to be detected in the aforementioned lubricating operations.

SUMMARY OF THE INVENTION

The present invention broadly contemplates the provision of a liquid flow switch comprising structure defining a chamber for liquid and having an inlet for introducing a flow of liquid to an upper level of the chamber, an outlet for discharging a flow of liquid from an upper level of the chamber, and an orifice of restricted cross section for bleeding liquid from the chamber at a level below the inlet and outlet, such that when the flow rate of liquid through the inlet exceeds the bleed rate of liquid through the orifice, the liquid level in the chamber rises to and remains at least at the level of the outlet, and when the bleed rate exceeds the inlet flow rate the liquid level in the chamber falls; and switch means, responsive to change of liquid level in the chamber, for producing a signal when the liquid level passes in at least one direction through a predetermined level in the chamber intermediate the level of the outlet and the level of the orifice.

The present invention, by providing a chamber with a bleed orifice below the liquid flow inlet and outlet, enables utilization of a generally conventional liquid level sensing switch to detect small changes in flow of liquids at low mass flow rates, as in gravity drains. The cross-sectional dimension of the bleed orifice, which determines the bleed rate of liquid from the chamber, establishes the threshhold flow rate value at which the switch means is actuated to produce a signal. In normal steady-state operation, with the monitored liquid flow rate (e.g. the flow rate of oil in a gravity drain) maintained at or above a preselected value corresponding to a desired operating condition (such as the presence of sufficient oil in an upstream trough), the liquid level in the chamber of the present switch is maintained at or above the level of the outlet, and liquid introduced to the chamber through the inlet not only flows out of the chamber through the bleed orifice but also overflows through the outlet. When, however, the inlet flow rate drops below the bleed rate through the chamber orifice, the liquid level in the chamber falls progressively, below the outlet level, until it passes through the actuation level at which the switch means produces a signal representative of insufficient flow rate. This signal indicates to the operator the presence of a condition requiring corrective action.

As a further particular feature of the invention, adjustable means may be provided for varying the cross-sectional area of the orifice so as to vary the rate at which liquid bleeds therethrough from the chamber. Since the threshold value (i.e. the value at which a signal is produced by the switch) of the flow rate is determined by the bleed rate, this adjustable means enables the operator to select the flow rate at which a signal will be produced. Advantageously, the adjustable means comprises an element mounted in the chamber-defining structure for movement into and out of the bleed orifice; thus, in currently preferred embodiments the adjustable means is a screw or the like threadedly mounted in the structure for movement into and out of the orifice in a direction transverse to the direction of liquid flow therethrough, and having a portion accessible from the exterior of the structure to enable the operator to effect such adjustment.

The inlet may be a first passage in the chamber-defining structure, opening into the chamber at about the level of the outlet, which comprises a second passage in the structure. Also conveniently, the bleed orifice is a third passage in the structure, and the orifice and outlet are connected downstream of the chamber by a common discharge passage opening to the exterior of the structure at a level at least as low as the level of the orifice.

In currently preferred embodiments of the invention, the switch means comprises a float disposed in the chamber for vertical movement in correspondence with the rise and fall of liquid level therein, and a signal-generating element switchable between two conditions, of which at least one causes a signal to be produced, in accordance with movement of the float above and below a position corresponding to the actuating level, i.e. the liquid level at which actuation of the switch occurs. The signal generating element may be a magnetically operable electric switch element having a circuit-open and a circuit-closed condition, and the float may be magnetically coupled to this switch element.

The method of the invention, for sensing changes in flow rate with a flow of liquid, comprises continuously delivering the flow of liquid to an upper level in a liquid-holding chamber having an outlet at an upper level therein for discharging liquid from the chamber, while continuously bleeding liquid from the chamber through an orifice of restricted cross-section at a level below the first-mentioned upper level and the outlet, such that the level of liquid in the chamber rises to and remains at least at the level of the outlet when the flow rate of liquid into the chamber exceeds the bleed rate of liquid through the orifice, and falls when the bleed rate exceeds the inlet flow rate; and producing a signal in response to passage of liquid level in the chamber in at least one direction through a predetermined level intermediate the level of the outlet and the level of the orifice.

Further features and advantages of the invention will be apparent from the detailed description hereinbelow set forth together with the accompanying drawings.

DETAILED DESCRIPTION

Figure 1:
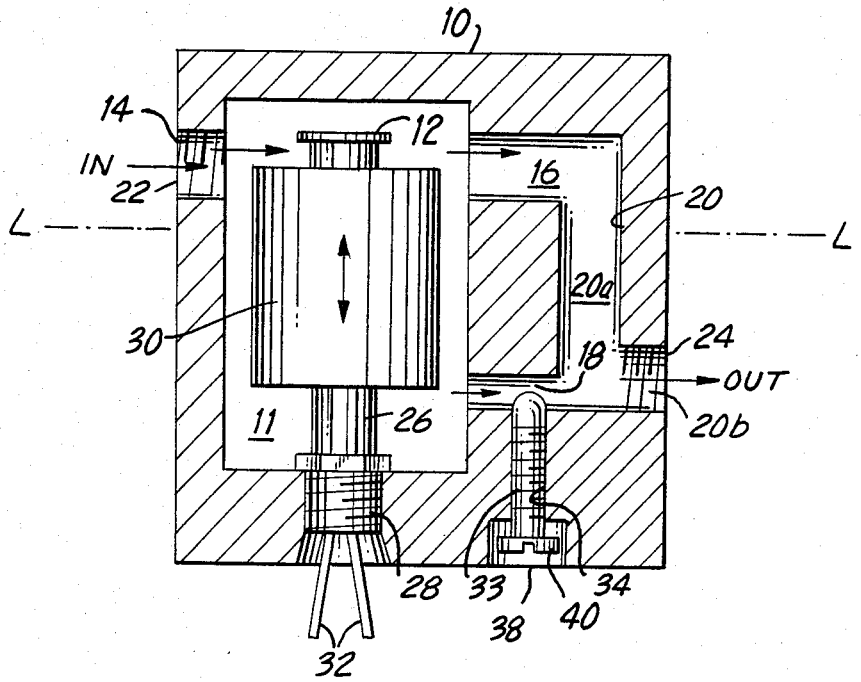
FIG. 1 is a schematic sectional elevational view of a liquid flow switch embodying the invention.
Figure 14:
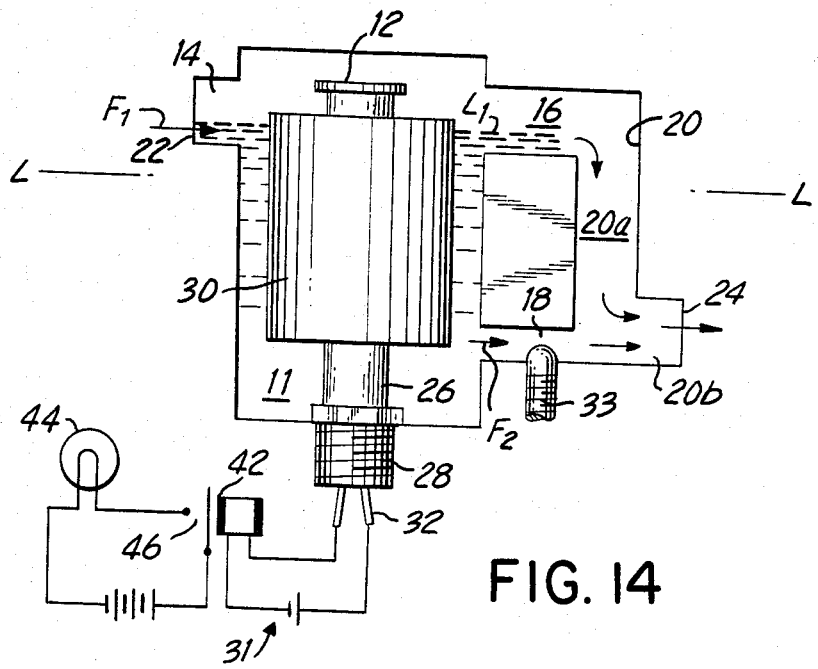
FIGS. 14 and 15 are simplified views, similar to FIG. 1, illustrating diagrammatically the operation of the FIG. 1 switch.
Figure 15:
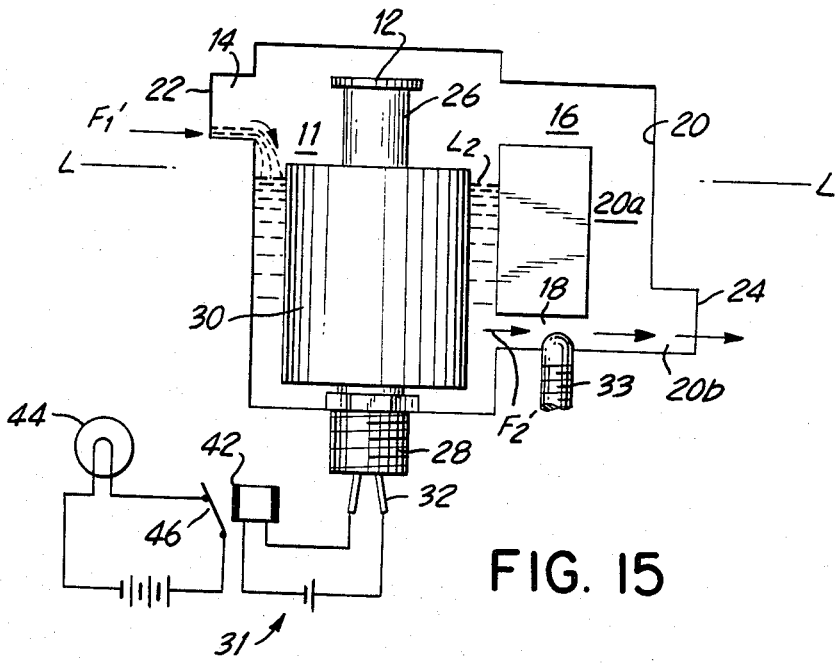

Referring first to FIGS. 1, 14 and 15, the invention is there illustrated schematically as embodied in a device including a metal block 10 defining an axially vertical float chamber 11, and a float-type liquid level sensing switch 12 disposed in the chamber. A flow of liquid to be monitored is introduced to the chamber through an inlet passage 14 formed in the block and opening into the chamber at an upper level therein. Also formed in the block 10 are an outlet passage 16, opening into the chamber 11 at the same level as the inlet passage; a bleed passage or orifice 18, opening into the chamber at a level substantially below the inlet and outlet passages; and an L-shaped discharge passage 20, connecting the outlet and bleed passages downstream of the chamber for conducting liquid from both of the latter passages to the exterior of the block 10 at a level not higher than the level of the bleed passage. The passages 14, 16 and 18 are axially horizontal cylindrical bores, while the passage 20 comprises an axially vertical cylindrical bore 20*a* and an axially horizontal cylindrical bore 20 leading to the exterior from the lower end of bore 20*a*. It will be understood that the passages and chamber cooperatively define a continuous path for flow of liquid through the block, from an inlet port 22 at the upstream end of the inlet passage to an outlet port 24 at the downstream end of the discharge passage. The single-headed arrows in FIG. 1 indicate the direction of flow of liquid in this path.

The switch 12 may be a conventional, commercially available liquid level switch unit comprising a magnetically operable electric switch element in the form of an axially vertical cylindrical stem 26, e.g. containing a reed switch (not shown), secured at one end to a base 28, and an axially vertical cylindrical float 30 concentrically surrounding the stem 26 so as to be freely movable up and down relative thereto (as indicated by the double-headed arrow in FIG. 1) over a limited path of travel. The float is magnetically coupled to the switch element by means of a permanent magnet (not shown) carried in the float, such that when the float passes a predetermined intermediate point in its path of travel, moving in one direction, electrical contacts within the stem 26 open and remain open until the float moves back through the same point in the opposite direction, at which juncture the contacts close and remain closed until the float again moves past the actuating point in the first direction. That is to say, switch-opening or -closing action (depending on the direction of float movement) occurs upon passage of the float through the predetermined actuating point, and the open or closed condition of the contacts is indicative of whether the float is above or below the actuating point. To produce an indicating and/or control signal, the contacts within the stem are connected to external electrical circuitry 31 (FIGS. 14 and 15) by wires 32 projecting from the base 28. The construction and operation of liquid level switch units of this type are well known and accordingly need not be further described.

In the device schematically illustrated in FIG. 1, the base 28 is shown as mounted in the block 10 at the lower end of the chamber 11, with the stem 26 projecting upwardly therefrom, but the switch 12 may alternatively be mounted in an inverted position, i.e. depending from the roof of the chamber; with one orientation, upward movement of the float in the chamber opens the switch, and with the other, upward movement of the float closes the switch. The circuitry to which the switch is connected by wires 32 may be arranged to produce a visible or audible signal when a predetermined switch-actuating displacement of the float occurs. As will be understood, the float is buoyed up by liquid within the chamber 11 in the illustrated device, and thus rises and falls with the liquid level in the chamber; accordingly, the float position that causes opening or closing of the contacts within stem 26 corresponds to a particular liquid level (herein termed the actuating level, and indicated by line L—L in FIG. 1) in the chamber. Of course, while the switch-actuating float position relative to the stem is typically invariant, being determined by the structural arrangement of the parts of the switch 12, the location of the actuating level L—L along the length of the stem is dependent on the specific gravity of the liquid of the flow being monitored. In the illustrated device, the relative vertical positions of the outlet passage 16, bleed passage 18, and stem 26 are selected so that the actuating level L—L lies between the outlet and bleed passage levels, being preferably slightly below the outlet passage.

For adjustment of the minimum cross-sectional area of the bleed passage 18, a blunt-nosed screw 33 is threadedly mounted in a bore 34 in the block 10. The bore 34 opens into the passage 18, being axially perpendicular to the direction of liquid flow through the latter passage, and extends outwardly therefrom to a port 38 in an outer surface of the block; the slotted head 40 of the screw is accessible through this port 38 to enable the screw to be turned manually with a suitable screwdriver. The nose of the screw projects into the bleed passage 18, thereby reducing the minimum cross-sectional area of the passage; the extent to which the screw thus reduces the bleed passage cross-sectional area can be varied by turning the screw to advance or retract it along the bore 34.

The operation of the above-described device may now be readily explained, with reference to FIGS. 14 and 15. By way of example, the device may be used to detect changes in flow rate of overflow oil in a gravity drain of a lubricating system. For such use, the inlet port 22 of the device is connected to receive the flow of oil from the gravity drain, and the outlet port 24 is connected to discharge the flow of oil from the device to suitable conduit structure for recycling the oil to the lubricating system. The wires 32 are connected to electrical circuitry 31 for producing a visible signal when the liquid level in the chamber 11 drops below the actuating level L—L at which the switch 12 opens or closes the circuit, thereby (as hereinafter explained) to indicate that the flow rate of oil in the gravity drain has fallen below a preselected threshold value determined by the setting of the screw 33.

Specifically, the circuitry 31 includes a relay 42 for opening and closing a circuit containing a light bulb 44, the relay being energized and de-energized by opening and closing of the contacts of the switch element in stem 26 such that the light bulb circuit is closed (to illuminate the bulb) when the liquid level in chamber 11 falls below the actuating level L—L. The circuitry shown is of course merely illustrative; for example, circuitry controlled by the switch 12 could be arranged to produce a different type of indicating signal, e.g. an audible signal such as a buzzer, or to produce a control signal to actuate operating equipment such as a liquid supply control valve or pump, and/or to produce an indicating or control signal when the liquid level in chamber 11 rises above the actuating level L—L.

At start-up, assuming that the inlet flow of oil from the gravity drain through port 22 is above the threshold value, the chamber 11 fills with oil to the level of the outlet 16, i.e. above the actuating level L—L, raising the float 30 above its actuating point so that the switch is in the condition (open or closed, depending on switch orientation as explained above) representative of acceptably high flow rate. Throughout this filling period, a bleed flow of oil is being discharged from the chamber through the bleed passage 18; however, the bleed passage aperture (minimum cross-sectional area) is made sufficiently small, by prior adjustment of the screw 33, to restrict the bleed rate (volume of oil per unit time) to a value less than the threshold value of inlet flow rate. Consequently, with the assumed inlet flow rate higher than the threshold value, more oil enters the chamber through the inlet passage 14 than is discharged through the passage 18, and the chamber fills as described.

When the oil level in the chamber reaches the outlet 16, oil overflows into the outlet passage and thence into the discharge passage, where it joins the bleed flow exiting through port 24. Thereafter, as long as the inlet flow of oil continues at a flow rate above the threshold value, the chamber 11 remains filled with oil to the outlet level; the float is buoyed up above its actuating point; and oil leaves the chamber through both the outlet passage and the bleed passage, the outflow rate through port 24 being equal to the inflow rate through port 22.

This steady-state condition, in which the inlet flow rate $F_1$ exceeds the bleed rate $F_2$ and the oil in the chamber 11 is maintained at a level $L_1$ (above the actuating level L—L) high enough to overflow into the outlet passage 16, is illustrated in FIG. 14. Because the liquid level $L_1$ is above the actuating level L—L, the float 30 is above its actuating point, and the relay 42 is in a condition in which the contacts 46 of the circuit containing light bulb 44 are open; hence the bulb is unlit, indicating a satisfactorily high flow rate of oil in the gravity drain being monitored.

If, however, the inlet flow rate through port 22 falls below the bleed rate through passage 18, more oil leaves the chamber through the bleed passage than enters through the inlet passage, and the level of oil in the chamber 11 drops progressively, below the outlet 16 and then below the actuating level L—L. Oil ceases to overflow through the outlet, of course, but more oil is leaving the device through port 24 than is entering through port 22, owing to the head of oil in the chamber 11 above the bleed passage 18. In this regard, it will be appreciated that the bleed rate through passage 18 is a function of the cross-sectional area of the narrowest point in that passage (determined by the setting of screw 33) and the head of oil above the bleed passage in the chamber; the screw setting is accordingly selected so that the bleed rate through passage 18, with oil at level L—L in the chamber, equals the inlet flow rate at which it is desired to actuate the switch to produce a signal (in the associated signal circuitry) by opening or closing.

As the level of oil in the chamber 11 falls in consequence of the diminished inlet flow rate, the float 30 correspondingly descends, until it reaches (and passes) the actuating point at which the switch contact opens or closes to produce the aforementioned signal indicating insufficient flow. This point, as explained above, is reached by the float when the oil level in the chamber reaches the actuating level L—L. This condition of insufficient flow rate (inlet flow rate $F_1'$ less than bleed rate $F_2'$) is illustrated in FIG. 15. The level $L_2$ of oil in the chamber falls below the actuating level L—L, and the concomitant descent of the float 30 past its actuating point operates the switch element in stem 26 to cause the relay 42 to close the contacts 46 of the circuit of light bulb 44, illuminating the bulb to indicate to the operator that the monitored flow rate has become insufficient. Thereby, i.e. upon reduction of flow rate in the gravity drain below the preselected threshold value, the operator is alerted to take corrective measures to restore desired normal operating conditions in the lubricating system.

The described device enables reliable detection, in a simple and convenient manner, of small changes in flow rate of a flow of liquid at mass flow rates too low to permit use of conventional flow switches that require flows of significant kinetic energy. The present device accomplishes this result by converting changes in volume flow rate to changes of liquid level in a chamber, so that commercially available liquid level sensing instrumentalities can be employed to monitor flow rate. Specifically, the device produces an indicating signal when the rate of the flow being monitored drops to or below a predetermined value, by virtue of the arrangement of a chamber with a bleed orifice (passage 18) having a restricted cross-section dimensioned to provide a bleed rate (i.e. when the chamber is filled to the level L—L) which is less than the desired normal rate of the monitored flow but equal to the aforementioned predetermined value. Advantageously, the bleed orifice dimension is made adjustable to enable precise setting of and/or change in the value of monitored flow rate at which the liquid level in the chamber falls to the actuating level L—L.

For rapid response of the device to change in flow rate, the diameter of the chamber 11 is desirably made as small as possible, consistent with free operation of the float, so that the liquid level will drop quickly when the inlet flow rate falls below the bleed rate. Positioning of the actuating level L—L close to (slightly below) the outlet level also contributes to desired rapidity of response.

The showing of FIGS. 1, 14 and 15 is simplified and schematic, to facilitate understanding of the functional arrangement of the features therein depicted. A currently preferred embodiment of the switch of the invention, adapted to monitor a flow of lubricating oil in a gravity drain, is illustrated in detail in FIGS. 2–13, wherein like features are designated by the same reference numerals as in FIG. 1. In this device, metal block 10 defines the chamber 11, the inlet port 22, the inlet passage 14, the outlet passage 16, the bleed passage 18, the discharge passage comprising vertical and horizontal portions 20*a* and 20*b*, and the outlet port 24, as well as the adjusting screw bore 34. The device of FIGS. 2–13 has a lid 50 through which the adjusting screw port 38 opens; the lid 50 also supports the switch unit 12, and is secured to the block 10 by screws 52.

Figure 2:
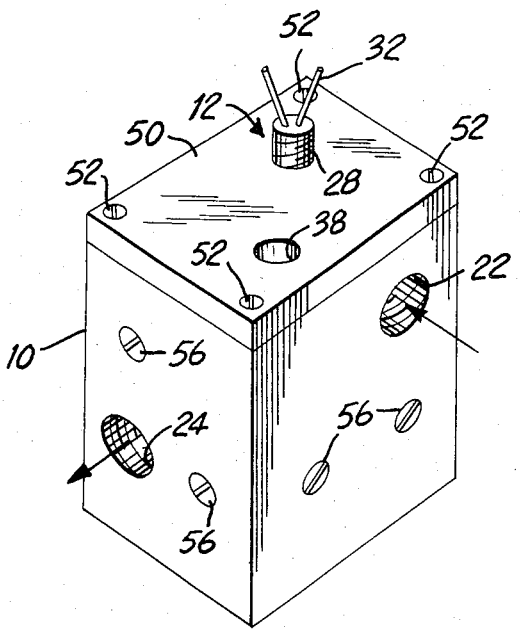
FIG. 2 is a perspective view of another embodiment of the invention.
Figure 3:
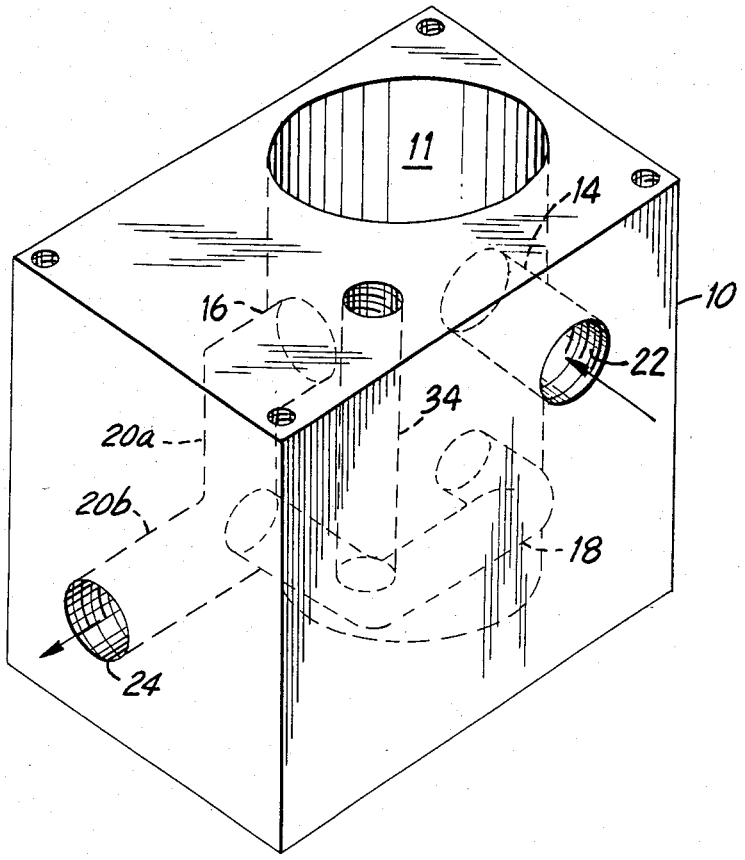
FIG. 3 is an enlarged and simplified perspective view of the chamber-defining block of the switch of FIG. 2.
Figure 4:
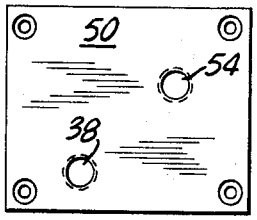
FIG. 4 is a somewhat reduced plan view of the lid of the switch of FIG. 2.
Figure 5:
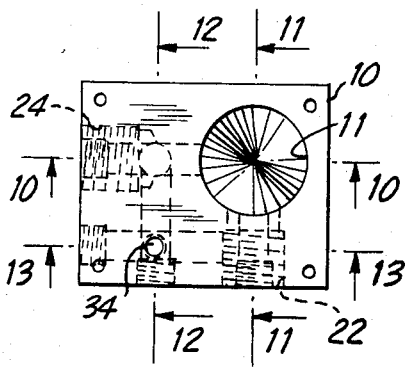
FIG. 5 is a plan view of the chamber-defining block of the FIG. 2 switch.
Figure 6:
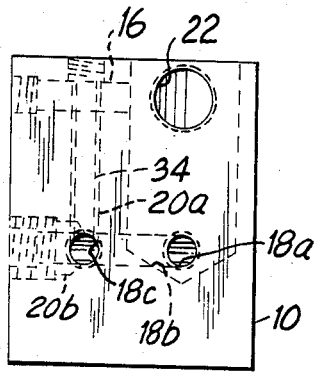
FIG. 6 is a side elevational view of the block of FIG. 5.
Figure 8:
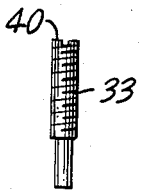
FIG. 8 is an elevational view of the bleed passage adjusting screw of the FIG. 2 switch.
Figure 7:
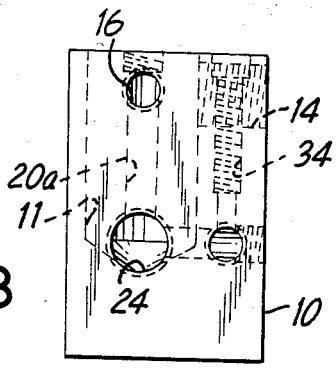
FIG. 7 is an end elevational view of the same block.
Figure 10:
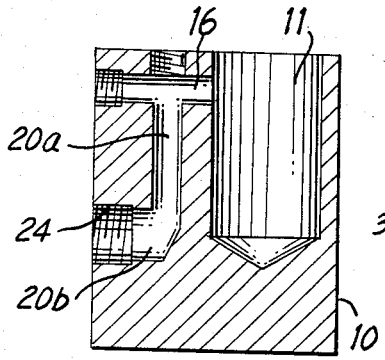
FIG. 10 is a sectional elevational view taken along the line 10—10 of FIG. 5.
Figure 9:
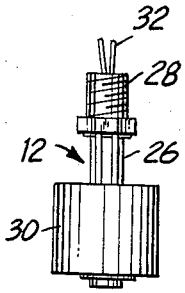
FIG. 9 is an elevational view of the liquid level sensing switch of the FIG. 2 embodiment of the invention.
Figure 11:
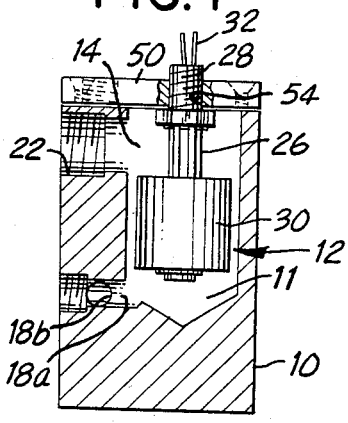
FIG. 11 is a sectional elevational view taken as along the line 11—11 of FIG. 5, showing also (but not in section) the lid and the level-sensing switch in their assembled positions.
Figure 12:
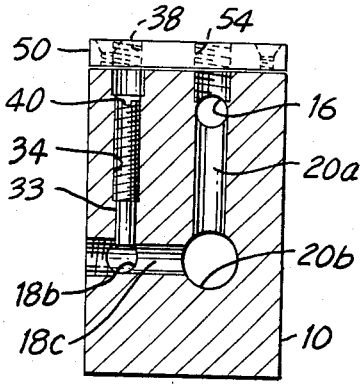
FIG. 12 is a sectional elevational view taken as along the line 12—12 of FIG. 11, also showing (but not in section) the lid and the bleed passage adjusting screw in their assembled positions.
Figure 13:
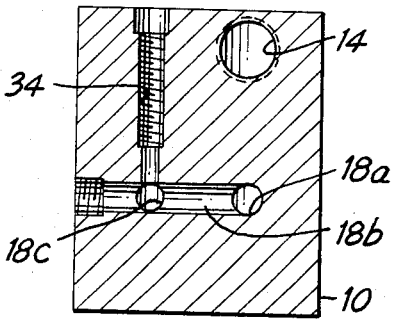
FIG. 13 is a view taken along the line 13—13 of FIG. 5.

As best seen in the schematic showing of FIG. 3, the device of FIGS. 2–13 differs from that of FIG. 1 in that the axis of the passage 14 is perpendicular to the plane containing the axes of passages 16, 20*a*, and 20*b*, rather than being coplanar therewith; the adjusting screw bore 34 opens (at port 38) through the top rather than the bottom of the device; and the axially horizontal bleed passage 18 is U-shaped rather than straight, to accommodate the upwardly opening arrangement of the bore 34, enabling access to the adjusting screw from above. The flat-nosed adjusting screw 33 (illustrated separately in FIG. 8, and in its assembled position in FIG. 12) thus projects downwardly into the passage 18, with its slotted head end 40 oriented upwardly. The outlet passage 16 is smaller in diameter than the inlet passage 18 but their axes lie in a common horizontal plane. Also, as best seen in FIGS. 4 and 11, the lid 50 has an opening 54 (positioned to be coaxial with the chamber 11 of the block 10) in which the base 28 of the switch unit 12 is mounted, the switch (shown separately in FIG. 9) being thus inverted with respect to the position shown in FIG. 1. The operation of the device of FIGS. 2–13 is identical to that of FIGS. 1 and 14–15, it being understood that the external signal circuitry (not shown in FIGS. 2–13) is appropriately modified in view of the inverted orientation of the switch unit 12 so as to produce an indicating signal upon descent of the float 30 to or past the actuating point, i.e. when the liquid level in the chamber 11 falls to or past the actuating level.

For convenience of manufacture, the chamber 11 and the various passages 14, 16, 18 and 20, as well as the screw bore 34, are formed by drilling bores of appropriate diameters in an initially solid metal block. Thus, the bleed passage 18 is formed by drilling a first horizontal bore 18*a* parallel to but beneath the inlet passage 14, drilling a second horizontal bore 18*b* perpendicularly intersecting bore 18*a*, and drilling a third horizontal bore 18*c* parallel to bore 18*a* and intersecting both bore 18*b* and discharge passage portion 20*a* (which is a vertical bore also intersecting outlet passage 16, a horizontal bore). The outer ends of all the passage bores 16, 18*a*, 18*b*, 18*c*, and 20*a* are internally threaded and are closed by threaded plugs 56 (FIG. 2). Inlet port 22 and outlet port 24 are also internally threaded, to receive suitable fittings for attachment of conduits leading a flow of oil to and from the device. The screw bore is internally threaded along most of its length to engage the threads of screw 33. Additionally, the port 38 may be internally threaded to receive a cap (not shown) for closing the screw bore 34, within which the slotted head 40 of the screw 33 is recessed; this cap is removed and a screwdriver inserted to engage the head 40 when it is desired to turn the screw for adjusting the extent to which the screw nose protrudes into passage 18, and thereby adjusting the minimum cross-sectional dimension of the bleed orifice or passage 18.

In a specific example of a device having the construction shown in FIGS. 2–13, a suitable switch unit 12 is a "Gems" LS-3 liquid level switch available from Transamerica Delaval Inc. of Lawrenceville, N.J., having a float of one inch diameter and one inch length with a stem length of 1 9/16 inches. Exemplary dimensions for the chamber 11 of an embodiment of the invention using this unit are a diameter of $1\frac{1}{8}$ inches and a length of $1\frac{7}{8}$ inches (from the top of block 10 to the center of bleed passage bore 18*a*). With these dimensions, the passages 16, 18 and 20*a* may each have a diameter of 0.339 inch, while passages 14 and 20*b* each have a diameter of 37/64 inch, and the center of passage 18 is spaced $1\frac{1}{2}$ inches below the centers of passages 14 and 16, the switch unit 12 being so positioned that the actuating level L—L is slightly below the lowest point of the inlet passage 14, and therefore also below the lowest point of the outlet passage 16. The diameter of the nose portion of screw 33 (which projects into passage 18) is 3/16 inch.

It is to be understood that the invention is not limited to the features and embodiments hereinabove specifically set forth, but may be carried out in other ways without departure from its spirit.

I claim:

1. A liquid flow switch comprising (a) structure defining a chamber for liquid and having an inlet for introducing a flow of liquid to an upper level of the chamber, an outlet for discharging a flow of liquid from an upper level of the chamber, and an orifice of restricted cross-section for bleeding liquid from the chamber at a level below the inlet and outlet, such that when the flow rate of liquid through the inlet exceeds the bleed rate of liquid through the orifice the liquid level in the chamber rises to and remains at least at the level of said outlet, and when said bleed rate exceeds said inlet flow rate the liquid level in the chamber falls; and (b) switch means, responsive to change of liquid level in the chamber, for producing a signal when the liquid level passes in at least one direction through a predetermined level in the chamber intermediate the level of said outlet and the level of said orifice.

2. A switch as defined in claim 1 including adjustable means for varying the cross-sectional area of said orifice to vary the rate at which liquid bleeds therethrough from the chamber.

3. A switch as defined in claim 2, wherein said adjustable means comprises an element mounted in said structure for movement into and out of said orifice.

4. A switch as defined in claim 3, wherein said element is threadedly mounted in said structure for movement into and out of said orifice in a direction transverse to the direction of liquid flow therethrough, and includes a portion accessible from the exterior of said structure for effecting movement of the element as aforesaid.

5. A switch as defined in claim 1, wherein said inlet is a first passage in said structure, opening into said chamber at about the level of said outlet; wherein said outlet is a second passage in said structure; wherein said orifice is a third passage in said structure; and wherein said orifice and said outlet are connected, downstream of said chamber, by a common discharge passage opening to the exterior of said structure at a level at least as low as the level of said orifice.

6. A switch as defined in claim 1, wherein said switch means comprises a float disposed in said chamber for vertical movement in correspondence with rise and fall of liquid level therein, and a signal-generating element switchable between two conditions, of which at least one causes a signal to be produced, in accordance with movement of the float above and below a position corresponding to said predetermined level.

7. A switch as defined in claim 6, wherein said signal-generating element is a magnetically operable electric switch element having a circuit-open and a circuit-closed condition, and wherein said float is magnetically coupled to said switch element.

8. A method of sensing change in flow rate of a flow of liquid, comprising (a) continuously delivering the flow of liquid to an upper level in a liquid-holding chamber having an outlet at an upper level therein for discharging liquid from the chamber, while (b) continuously bleeding liquid from the chamber through an orifice of restricted cross-section at a level below the first-mentioned upper level and the outlet, such that the level of liquid in the chamber rises to and remains at least at the level of the outlet when the flow rate of liquid into the chamber exceeds the bleed rate of liquid through the orifice, and falls when said bleed rate exceeds said flow rate, and (c) producing a signal in response to passage of liquid level in the chamber in at least one direction through a predetermined level intermediate the level of said outlet and the level of said orifice.

* * * * *